United States Patent [19]

Lakhani

[11] 4,141,317

[45] Feb. 27, 1979

[54] MULTIPLE APPLICATOR ROLLER TONER STATION

[75] Inventor: Kishor M. Lakhani, Oklahoma City, Okla.

[73] Assignee: Honeywell Information Systems Inc., Waltham, Mass.

[21] Appl. No.: 839,715

[22] Filed: Oct. 5, 1977

[51] Int. Cl.[2] ..... G03G 15/10

[52] U.S. Cl. ..... 118/661; 118/651; 118/652; 101/DIG. 13

[58] Field of Search ..... 101/DIG. 13; 118/661, 118/651, 652, 662

[56] References Cited

U.S. PATENT DOCUMENTS

| | | | |
|---|---|---|---|
| 3,256,855 | 6/1966 | Oliphant | 118/661 X |
| 3,367,791 | 2/1968 | Lein | 118/661 X |
| 3,596,635 | 8/1971 | Smitzer | 118/661 |
| 3,774,574 | 11/1973 | Sato et al. | 118/651 X |
| 3,816,114 | 6/1974 | Fukushima et al. | 118/651 X |
| 3,817,212 | 6/1974 | Fukushima et al. | 118/661 X |
| 3,893,417 | 7/1975 | York | 118/661 |

*Primary Examiner*—Werner H. Schroeder
*Assistant Examiner*—Andrew M. Falik
*Attorney, Agent, or Firm*—Nicholas Prasinos; Ronald T. Reiling

[57] ABSTRACT

A method and apparatus for developing an electrographic-latent image on a pre-treated paper medium, by utilizing multiple rollers partially dipped in a liquid carrier.

A pre-treated paper medium comprised of a conductively treated paper base supporting a plastic dielectric coating on each of its sides, is positioned between electrode assemblies comprised of matrices of a plurality of styli which receive variable information in the form of electronic signals from a data processor, or other equipment and by selectively changing the plurality of styli generating a latent electrographic image of alphanumeric characters or other variable printing by electrostatic discharge on the paper which is retained by the coating.

The latent image is developed, i.e., made visible, by subjecting the paper medium to charged toning particles suspended in a liquid toning carrier. Multiple rollers, one each at predetermined locations, are partially submerged in a liquid toning carrier and pick up sufficient toning so as to form a meniscus between the upper portions of each roller and the paper medium. The image is then fixed i.e., made permanent by vaporizing the liquid carrier with heat.

10 Claims, 4 Drawing Figures

MULTIPLE APPLICATOR ROLLER TONER STATION

RELATED ARTICLES, APPLICATIONS AND PATENTS

1. "A Two-Sided Non-Impact Printing System", by R. F. Borelli and K. M. Lakhani, filed on an even date with the instant application and assigned to the same assignee as the instant application.

2. "Two-Side Multi Roller Toner Applicator Station for Electrographic Non-Impact Printer", by K. M. Lakhani, filed on an even date with the instant application and assigned to the same assignee as the instant application and having U.S. Ser. No. 839,692.

3. "A Non-Impact Page Printing System", by R. F. Borelli, R. B. Bayless and E. R. Truax, published in the *Honeywell Computer Journal,* Volume 8, No. 3, pp 67–80 in 1974.

4. "A Non-Impact Page Printing System", by R. F. Borelli, R. B. Bayless and E. R. Truax, published in *Computer Magazine* of the Institute of Electrical and Electronic Engineers, 5855 Haples Plaza, Long Beach, California, in September 1975. (Condensed version of the article of Item 3).

5. U.S. Pat. No. 3,687,107, issued 8/29/72, entitled "Printing System", and assigned to Honeywell Inc., the parent corporation of the instant assignee.

6. U.S. Pat. No. 3,624,661, issued 11/30/71, entitled "Electrographic Printing System With Plural Staggered Electrode Rows", and assigned to Honeywell Inc., the parent corporation of the instant assignee.

7. U.S. Pat. No. 3,958,251, issued 5/18/76, entitled "Electrographic Printing System Utilizing Multiple Offset Styli", and assigned to Honeywell Information Systems Inc., the same assignee as the instant invention.

8. U.S. Pat. No. 3,812,780, issued 5/28/74, entitled "Electrographic Forms Print Station", and assigned to the same assignee as the instant invention.

9. U.S. Pat. No. 3,839,071, issued 10/1/74, entitled "Printing Method", and assigned to Honeywell Inc., the parent corporation of the instant assignee.

10. U.S. Pat. No. 3,983,815, issued 10/5/76, entitled "Apparatus and Method for Printing on Plain Paper", and assigned to the same assignee as the instant invention.

11. U.S. Pat. No. 3,569,982, issued 3/9/71, entitled "Electrostatic Printer with Scanning Dielectric Segment", and assigned to Honeywell Inc., the parent corporation of the instant assignee.

12. U.S. Pat. No. 3,521,880, issued 7/28/70, entitlted "Processing Station with Document Handling and Aligning Means", and assigned to Honeywell Inc., the parent corporation of the instant assignee.

BACKGROUND OF THE INVENTION

1. Field of the Invention

The invention relates to an apparatus and method for printing upon a recording medium and more particularly to an apparatus for printing permanent images electrographically upon a paper medium at comparatively high speeds as is required in a computer print-out apparatus.

2. Description of the Prior Art

It had long been recognized that computer peripherals, particularly computer print-out apparatus, were bottlenecks in the total performance of a computer system. The majority of hard copy output devices for computer systems were and still are comprised of printers which impact the paper medium with print hammers. The movement of such print hammers not only limits the speed of which read-out can be accomplished, but are noisy and difficult to maintain. In order to increase the speed, facilitate maintenance, and still maintain print quality, a system was developed and is now being marketed commercially by Honeywell Information System Inc. utilizing electrographic techniques to accomplish non-impact printing. Such a printing system is disclosed in the related articles, applications and patents cited supra.

One main problem in the design of such an electrographic printing system arising at the toner station where the latent electrographic image is developed, i.e., made visible by subjecting the paper medium to charged toning particles suspended in liquid toning carrier. The problem is to increase the variable print densities greater than a reflective print density of 0.85 yet not substantially increase the speed of the paper medium in excess of 30 inches per second. There are several methods of attack to this problem. Referring to FIG. 1 some of these approaches will be discussed. FIG. 1 shows a toning station 100 which is comprised of a toning reservoir 105 containing toning liquid 106. Toning liquid is comprised of positive charged toner particles which are dispersed in a liquid carrier typically Isopar-L (a trademark of Exxon Corporation). A paper medium 103 pre-treated with dielectric 104 travels to the toner station in the direction of arrow 107. The dielectric face 104 has negative electrical charges in a pattern determined by previous operations thereon as described in the above-related references and in particular references 1–7. At the toner station a transfer roll comprised of any suitable conductive materials such as wear resistance steel is partially submerged in the toner liquid 106 and rotates counter clockwise at a constant speed and picks up toner liquid 106 and carries it to the meniscus 102 formed by the gap between the transfer roll 101 and the dielectric coded paper 103, 104. Since there are negative charges in a selected pattern on the dielectric 104 of the paper 103, the positively charged toner particles suspended in the meniscus 102 will travel to the dielectric surface 107 where they will be captured by the negative charges thereon and adhere thereto. It is obvious that the more toner particles deposited on the dielectric surface 104, the greater will be the print density. One way of depositing more toner particles is to decrease the gap between the tranfer roll 101 and the dielectric surface 104. Since the field E from the grounded transfer roll 101 to the dielectric surface 107 is inversely proportional to the gap between the transfer roll and the dielectric coded paper (i.e., the closer the transfer roll to the dielectric surface the greater the field) more particles would be deposited on the paper. However, by making the gap between the transfer roll 101 and the dielectric surface 104 smaller, the meniscus 102 is reduced and accordingly will hold less toner particles. Hence this would tend to decrease the print density. This could be remedied somewhat by increasing the speed of the transfer roll 101 but there is a maximum rotational speed which is determined by the centrifugal force at the outer rim of the transfer roll 101. The greater the speed, the greater will be the centrifugal force at the rim of the transfer roll 101 and would cause splattering of the toner mix onto the dielectric surface 104 which is undesirable. Another way of increasing the print density is to make the toner meniscus 102 longer; hence it will have more toner particles and also the dielectric coded paper 103 will remain in the meniscus for a longer period of time. One way to make the meniscus 102 longer is to make the transfer roll 101 larger. However, this would require a deeper reservoir and the slowing down of the revolutions per minute of the roll in order not to exceed the peripheral speed; some form of gear reduction would be necessary. Moreover, there is a limit to increasing the size of the meniscus using this technique.

Another major problem in developing the latent electrographic image is print contrast. This problem is at the opposite pole of the previous problem in that what is required is that the background density i.e., the density of the toner particles on the portion of the paper not selectively charged, should be kept as low as possible. Yet another problem related to the second problem is that of background staining of the paper as it passes through the transport. These and other problems encountered do not offer trivial solutions in developing the latent electrographic image with clarity, high print density, low background density of toner particles, and minimization of background staining.

OBJECTIONS OF THE INVENTION

It is a primary object of the invention to provide an improved non-impact printing system.

It is another object of the invention to provide an improved method and apparatus for developing latent electrographic images.

It is another object of the invention to provide improved apparatus and a method for developing the latent electrographic images.

It is still a further object of the instant invention to increase the time that a latent electrographic image spends in the development zone.

Further object of the instant invention is to provide a multiple applicator roller toner station for developing latent electrographic images.

A further object of the invention is to provide multiple applicator multiple dryer roller station for an electrographic printing system.

SUMMARY OF THE INVENTION

The foregoing objects of the instant invention are achieved by a method and apparatus for developing latent electrographic images utilizing multiple toner applicator rollers, multiple roller dryer stations in combination with positive bias rollers.

A pre-treated paper medium comprised of a conductively treated paper base supporting a plastic dielectric coating on one of its two sides, which has been selectively charged on the dielectric side by a plurality of styli, is developed by subjecting the paper medium to charged toning particles suspended in a liquid toning carrier. The toning liquid is applied to the moving dielectric paper by a plurality of rollers which are submerged in a toning liquid. To minimize toning particles being retained on the surface of the dielectric paper in areas where it has not been selectively charged, a positive charge is applied on the non-dielectric side of the coated paper via the positive bias rollers.

The residual electrostatic field of the dielectric surface of the paper attracts the particles suspended on the toner liquid and holds them, thus making the images visible. Subsequent vaporization of the liquid carrier removes the vapor leaving the particles behind, which harden and make a permanent bond with the plastic coated surface.

DESCRIPTION OF THE PREFERRED EMBODIMENTS OF THE INVENTION

General

In an electrographic printing system a pre-treated paper medium comprised of a conductively treated paper base supporting a plastic dielectric coating on at least one of its sides, is positioned between at least two electrode assemblies each assembly comprised of a matrix of styli which receive variable information from a data processor, or other apparatus. By selectively charging the plurality of styli, a latent image of alphanumeric characters or other type of variable printing is generated by the electrostatic discharge on the paper which is retained by the plastic coating. The latent image is then developed by subjecting the paper medium to charged toning particles suspended in liquid toning carrier.

Figure 1:
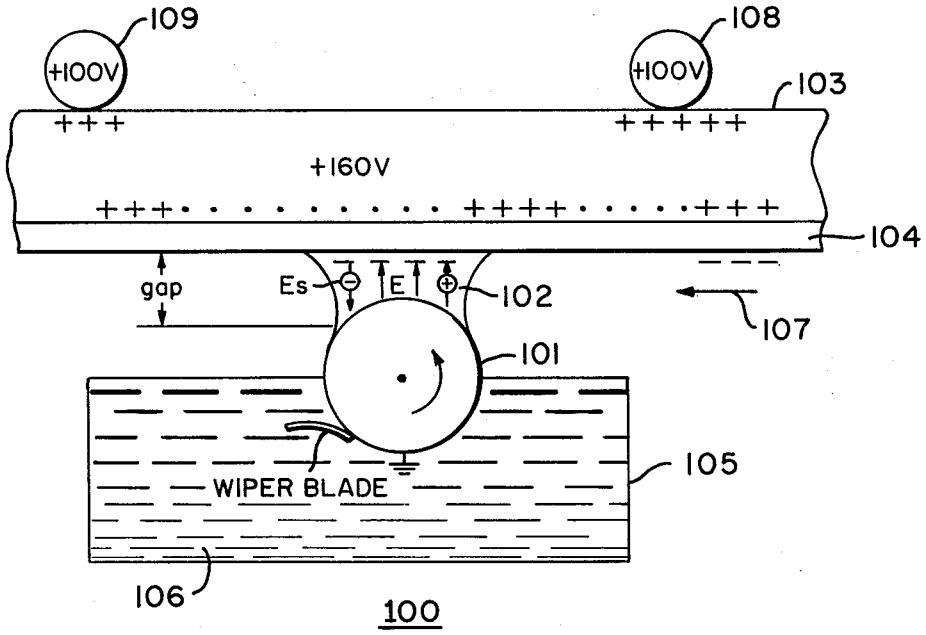
FIG. 1 illustrates the basic principles of applying toner solution to a dielectric coated paper.

In developing these latent images there are two general prior art techniques of applying the toning particles suspended in a liquid toning carrier to the paper medium. One technique is to dip the paper into the liquid toner medium which carries the toner carriers. Another technique is to bring the toner liquid to the paper and subsequently vacuum the excess toner off the paper. These prior art techniques suffer from low print densities, poor contrast and low speed. These problems have been discussed in part supra utilizing FIG. 1. The instant invention offers some solutions to these problems as follows:

1. Toner solution is applied only on the dielectric side of the paper minimizing the amount of toner absorbed by the paper.

2. Multiple toner applicator rollers are used to apply the toner solution thus increasing the amount of toner applied to the dielectric coated paper and also increasing the dwell time of the dielectric coated paper in the toner medium; additionally the use of multiple toner-applicator rolls serves to prevent depletion of charged toner particles from the carrier liquid by replenishing the toner carrier liquid at each revolution.

Paper scrapers remove the depleted toner mix from the surface of the dielectric which otherwise would tend to impede the flow of charged toner particles to the dielectric which is freshly supplied by each toner-applicator roll.

Bias rollers at some electric potential between plus 40 volts to 100 volts produce a weak bias field which opposes the attraction of toner particles to any weak triboelectric charge on the paper produced by the passage of the paper web over the transport rollers, thus minimizing the background staining of the paper as it passes through the transport.

THE TWO ROLLER TONER APPLICATOR EMBODIMENT

Figure 2:
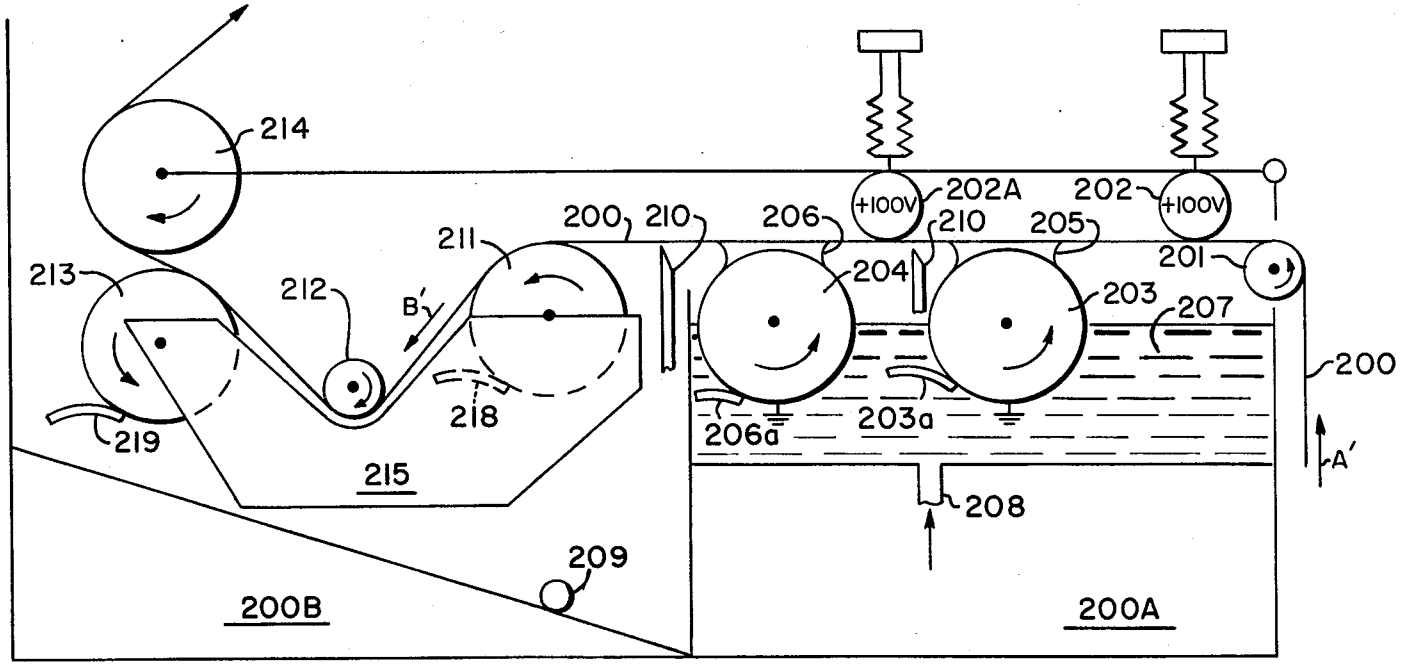
FIG. 2 is a schematic diagram of one embodiment of the invention utilizing two applicator rolls.
Figure 3:
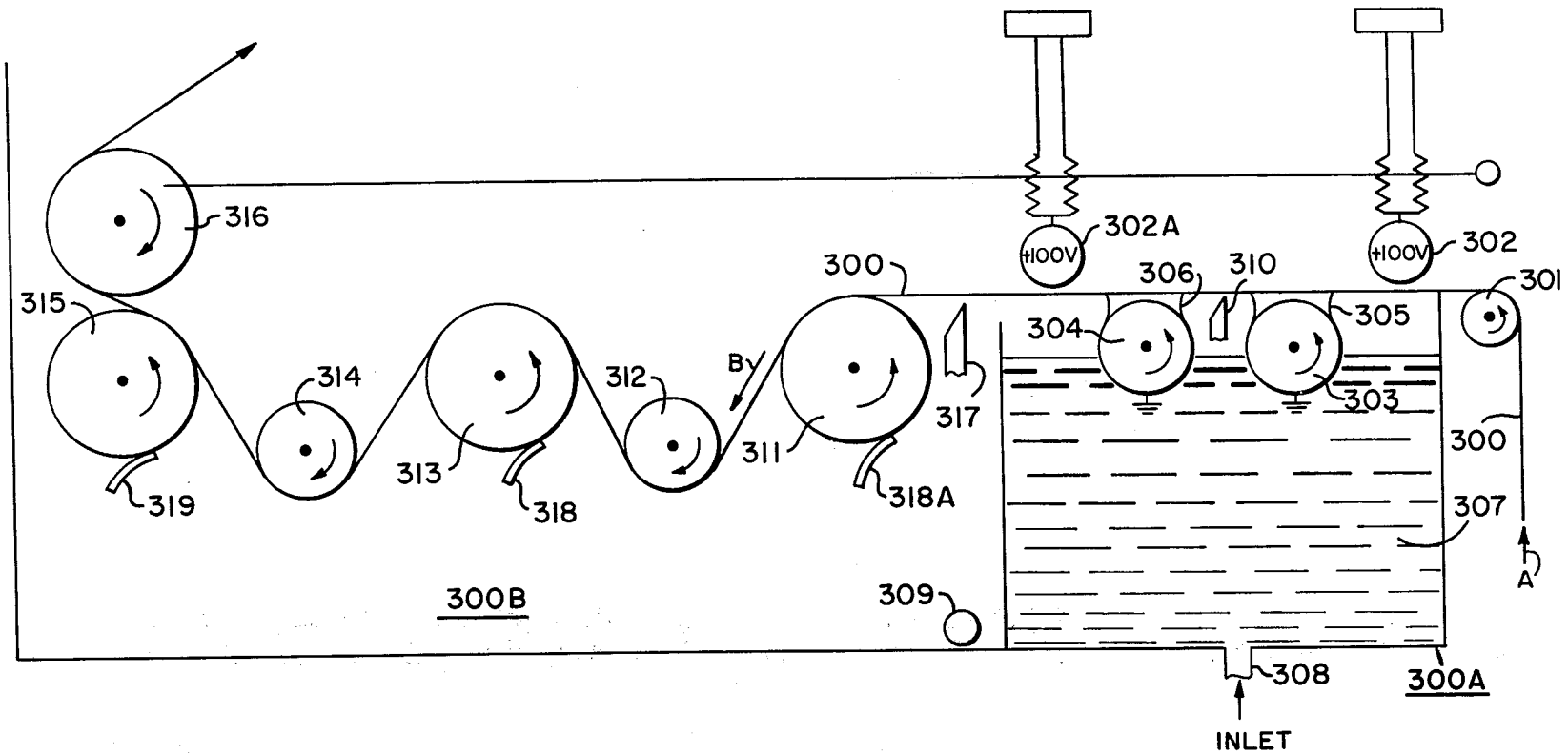
FIG. 3 is a schematic diagram of another embodiment of the invention having two toner applicator rolls and multi drying rolls.

Referring to FIGS. 2 and 3 the dielectric coated paper 200, 300 traveling in the direction of the arrows A, A', at a typical speed of about 30 inches per second passes over guide roller 20, 301 to enter the developing station where the latent electrographic images on the surface of the dielectric paper are to be developed. (For a more detailed description of a typical dielectric paper utilized by the invention, see references 1 through 6 supra). The dielectric coated paper 200 is then guided under the first bias roller 202, 302 where a positive potential of between 40 to 100 volts is applied. This potential produces a weak bias field which opposes the attraction of toner particles to weak static charges on the paper which are produced by the passage of the paper over the transport rollers, yet this field is not strong enough to oppose the attraction of toner particles to the selectively charged areas on the paper. Thus background staining of the paper as it passes through the transport is reduced, and hence the contrast between the desired electrographic image and the background is heightened.

The treated paper 200 then passes over transfer rollers 203, 204 and 303, 304 respectively. The distance between the treated paper 200 and the transfer rollers is typically 0.005 inches. The transfer rollers rotate counter clockwise at a typical speed of 400 revolutions per minute so that their circumference travels in the same relative direction as the paper medium. Liquid toner 207, 307 which is pumped through inlet 208, 307 is carried by the partially submersed rollers to the dielectric side of the treated paper medium, and forms a meniscus 205, 206 and 305, 306 with the dielectric base of the paper medium. As previously described with respect to FIG. 1, positively charged toner particles 102 under the influence of field E created by the selective negative charges on the surface of the dielectric 104 with respect to the grounded transfer roller 101, are deposited on the negatively charged portions of the dielectric surface 104 of the paper medium 103. As the paper 200 travels from transfer roller 203, 303 to transfer roller 206, 306 a scraper 210, 310 scrapes off excess toner liquid from the dielectric surface of paper medium and scrapers **203*a*, 206*a*, scrape the surface of rollers 203 and 204 respectively. This permits the application of fresh toner liquid via the second toner applicator roll 206, 306 without being diluted by the depleted liquid whose positively charged particles have been removed by the negative charges on the dielectric surface at the first toner applicator roll 203, 303. This assures a greater concentration of toner particles at the second meniscus 206, 306** and thus greater print density.

As the paper medium 200, 300 emerges from the toner applicator station 200A, 300A it enters the dryer station 200B, 300B FIGS. 2 and 3 respectively where it is applied to drying rollers 211, 213, 214, 311, 313, 315 and 316 respectively. Dryer rollers are of approximately the same size as the toner applicator of about 1.75 inches in diameter. At the drying station 200B, 300B the paper 200, 300 is scraped of excess toner liquid by scrapers **210, 218, 219, 318, 318*a* and 319, and is squeezed dry by the dryer rollers 211, 213, 214, 311, 313, 315 and 316. (It should be noted that these rollers are supported on some means of support such as the casting 215**).

One of the problems of the drying station of FIG. 2 is that the liquid toner carried out by the paper was excessive and in addition to making the paper difficult to handle, carried out excessive liquid which could otherwise be salvaged via the toner station 200B and the outlet 209. Accordingly, a larger number of transfer and idler rolls 300–316 were incorporated with scrapers 317, 319 before selected ones of the dryer rolls. The developing station of FIG. 3 is thus more efficient than that of FIG. 2 and produces greater print density with greater contrast.

ANOTHER EMBODIMENT OF THE INVENTION

Figure 4:
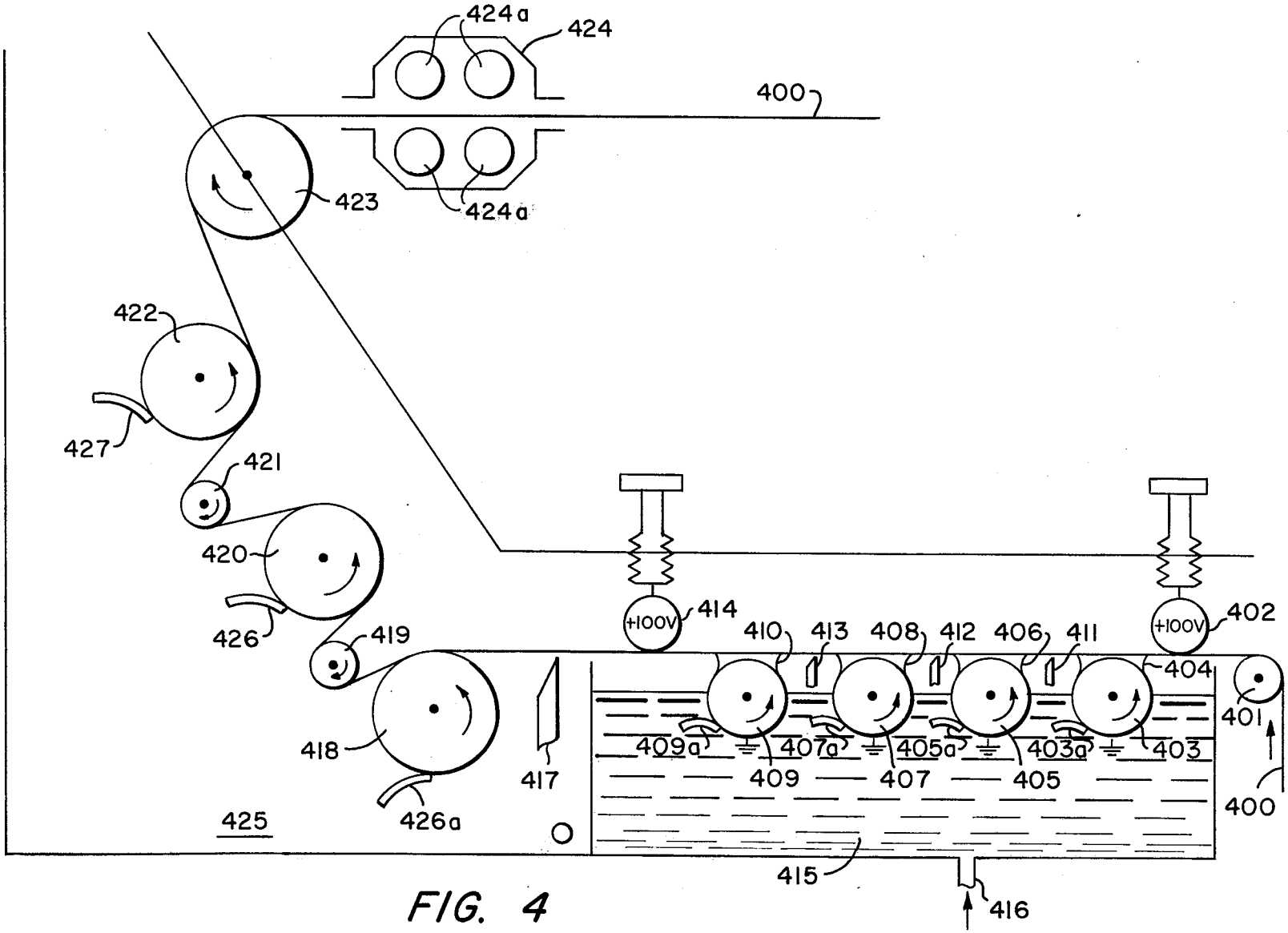
FIG. 4 is still another embodiment of the invention having multiple toner application rollers and multiple drying rollers.

Referring to FIG. 4 there is shown a schematic diagram of a multi-roller toner applicator multi-dryer station including a hot air dryer. The invention is essentially the same in concept as previously described. However, because of multiple roller application, the paper medium has a greater dwell time in the toner solution and accordingly picks up a greater number of charged particles resulting in greater image density. Furthermore, the increased number of drying rollers and the hot air drying station further increase the efficiency of recycling the toner liquid and erase the efficiency of recycling the toner liquid and furthermore produce greater contrast. Referring to FIG. 4 treated paper medium 400 is guided over a guide roll 401 and over transfer rollers 403–409. These transfer rollers are about 0.75 inches in diameter as compared to the transfer rollers of FIGS. 1 and 2 which are typically 1.75 inches in diameter. The treated paper 400 also passes over a greater number of scraping operations via scrapers 411, 412 and 413 respectively thus enhancing the print density in accordance with the principles discussed supra. The positive bias rollers 402 and 414 serve the same function as previously described to prevent background staining of the dielectric surface of the treated paper medium.

The first drying station 425 is comprised of drying and idler rollers 418, 419, 420, 421 and 422, and scrapers **417, 426, 426*a* and 427. Additionally there is another drying station 424 comprised of outlets 424*a* wherein hot air is guided over the treated paper 400. Thus with this number of drying rollers, scrapers and a hot air station any liquid which would tend to remain on the paper with its toner particles would be substantially completely removed. Hence no liquid toner carrier would remain behind upon completion of the evaporation of the liquid which causes background problems and gives poor contrast because of smudging the developed images. Additionally the evaporated liquid may be rerouted back to the tank 105**, containing the toning liquid where it would condense when introduced into the cooler liquid.

While the present invention has been described in connection with particle embodiments thereof, it is to be understood that modification of these embodiments, as well as other embodiments utilizing the underlying principle of the invention are included with the spirit and scope of the invention which is to be limited only by the accompanying claims.

What is claimed is:

1. In an electrographic printing system wherein a recording medium moves along a predetermined path, said printing system including a print station for applying a latent electrostatic charge to a recording medium and a toner station for applying to the recording medium a toning liquid comprised of a suspension of colored particles in a volatile carrier, the improved apparatus for applying the toning liquid to the recording medium and for removing the volatile carrier from the recording medium for fixing the colored particles permanently to the recording medium comprising in combination:

a receptacle for containing the toning liquid comprised of a suspension of colored particles in a volatile carrier;

a first roller-applicator rotatably mounted on said receptacle adjacent to the predetermined path of said recording medium and partially submerged in said toning liquid, for applying toner liquid to one side of said recording medium;

a second roller-applicator rotatably mounted to said receptacle in tandem to said first roller-applicator and adjacent to the predetermined path of said recording medium, and also partially submerged in said toning liquid, for applying additional toner liquid to said one side of said recording medium; and, at least one bias roller located adjacent to the path of the recording medium and situated on the opposite side of the recording medium and offset along the path of the recording medium in relation to said first and second roller applicators.

2. The electrographic printing system as recited in claim 1 including a first scraper between said first and second roller applicators adjacent to the predetermined path, for scraping excess liquid from the recording medium.

3. The electrographic printing system as recited in claim 2 including a third roller-applicator rotatably mounted to said receptacle in tandem with said first and second roller-applicators and adjacent to the predetermined path of said recording medium and also partially submerged in said toning liquid, for applying additional toner liquid to said one side of said recording medium.

4. The electrographic printing system as recited in claim 3 including a second scraper between said first and second roller applicators adjacent to the predetermined path, for scraping excess liquid from the recording medium.

5. The electrographic printing system as recited in claim 4 wherein a bias voltage of a least plus 40 volts is applied to said bias roller.

6. The electrographic printing system as recited in claim 4 including a plurality of dryer-rollers adjacent to the predetermined path of said recording medium and located after said first and second applicator rollers, said dryer-rollers for squeezing out excess toning liquid from said recording medium.

7. The electrographic printing system as recited in claim 6 including at least one scraper after each dryer-roller for scraping off excess toning liquid from said recording medium.

8. The electrographic printing system as recited in claim 7 including evaporation means after said dryer rollers positioned on each side of the recording medium for evaporating the volatile liquid carrier adhering to the recording medium.

9. The electrographic printing system as recited in claim 8 including means for rerouting the volatile liquid to said receptacle.

10. In an electrographic printing system wherein a recording medium moves along a predetermined path, said printing system including a print station for applying a latent electrostatic charge to a recording medium and a toner station for applying to the recording medium a toning liquid comprised of a suspension of colored particles in a volatile carrier, the improved apparatus for applying the toning liquid to the recording medium and for removing the volatile carrier from the recording medium for fixing the colored particles permanently to the recording medium comprising in combination:

a receptacle for containing the toning liquid comprised of a suspension of colored particles in a volatile carrier;

a plurality of roller-applicators rotatably mounted in tandem on said receptacle and adjacent to the predetermined path of said recording medium, and with each roller partially submerged in said toning liquid, for applying toner liquid to one side of said recording medium;

at least one bias roller located adjacent to the path of the recording medium and situation on the opposite side of the recording medium and offset at one end and along the path of the recording medium in relation to said plurality of roller applicators; and, a plurality of dryer-rollers adjacent to the predetermined path of the recording medium and situated after said plurality of roller-applicators, said plurality of dryer-rollers for squeezing out the excess toning liquid from the recording medium.

* * * * *

UNITED STATES PATENT OFFICE

CERTIFICATE OF CORRECTION

Patent No. 4,141,317 Dated February 27, 1979

Inventor(s) Kishor M. Lakhani

It is certified that error appears in the above-identified patent and that said Letters Patent are hereby corrected as shown below:

Column 7, line 46, delete "a" second occurrence and insert --at--.

Signed and Sealed this

*Fourteenth* Day of *August 1979*

[SEAL]

*Attest:*

*Attesting Officer*

LUTRELLE F. PARKER

*Acting Commissioner of Patents and Trademarks*